US006205892B1

(12) United States Patent
Davidson

(10) Patent No.: US 6,205,892 B1
(45) Date of Patent: Mar. 27, 2001

(54) ADJUSTABLE WRENCH

(76) Inventor: Johnnie F. Davidson, 6941 Nine Mile Bridge Rd., Fort Worth, TX (US) 76135-9261

( * ) Notice: Subject to any disclaimer, the term of this patent is extended or adjusted under 35 U.S.C. 154(b) by 0 days.

(21) Appl. No.: 09/237,287

(22) Filed: Jan. 25, 1999

(51) Int. Cl.[7] ..... B25B 13/18
(52) U.S. Cl. ..... 81/128; 81/309
(58) Field of Search ..... 81/126, 128, 309

(56) References Cited

U.S. PATENT DOCUMENTS

| | | | | |
|---|---|---|---|---|
| 680,540 | | 8/1901 | Ogle . | |
| 1,250,690 | | 12/1917 | Stallings . | |
| 1,401,931 | | 12/1921 | Whelan . | |
| 1,498,488 | | 6/1924 | Stallings . | |
| 2,592,098 | * | 4/1952 | Zimdars | 81/309 |
| 3,195,381 | * | 7/1965 | Meggs | 81/128 |
| 5,249,490 | * | 10/1993 | Kennel | 81/128 X |
| 5,542,319 | | 8/1996 | Wei . | |

* cited by examiner

*Primary Examiner*—James G. Smith
(74) *Attorney, Agent, or Firm*—Charles D. Gunter, Jr.

(57) ABSTRACT

The invention is an adjustable wrench comprising a stationary arm with a terminal end and a grip end, the terminal end defining a lower bolt claw. A ratchet arm is slidably coupled to the stationary arm, the ratchet being movable to control the movement of upper and central bolt claws. The upper, central, and lower bolt claws are fitted to the shape of a standard hexagonal bolt head, being adjustable to different sized bolts upon up or down movement of the ratchet arm relative to the stationary arm. The central bolt claw is fitted through a slot in the upper bolt claw which defines an inclined ramp surface such that movement of one claw is coupled to movement of the other claw. The claws move cooperatively in reaction to the stationary, lower bolt claw to form a tightly fitted surface for a bolt head. The stationary arm has a complex profile on its lower surface for contact with a ratchet pawl pivotally attached to the ratchet arm. The ratchet arm is kept away from the stationary arm by a spring, being manually pushed toward from the stationary arm during adjustment of the wrench to a bolt.

20 Claims, 13 Drawing Sheets

ADJUSTABLE WRENCH

BACKGROUND OF THE INVENTION

1. Field of the Invention:

The present invention relates in general to an adjustable wrench, and in particular to a ratcheted adjustable bolt wrench. Still more particularly, the present invention relates to an adjustable, three-jawed wrench that is ratcheted, to be used for any size hexagonal bolt.

2. Description of the Prior Art:

Bolt wrenches are an old art. There are primarily three general types of wrenches: socket wrenches, fixed end wrenches, and adjustable wrenches. In each type of wrench, there are several common ideal features. The wrench should be easy to use, since one-handed applications may be necessary in practice. Second, the head of the wrench, the section of the wrench that actually grips a bolt, must be able to grip the bolt in such a way that the corners of the standard hexagonal bolts are not stripped. Once stripped, the bolts become very difficult if not impossible to work with, and must be mechanically cut and replaced.

Of the three basic types of wrenches in current use, adjustable wrenches offer the most versatility. Further, adjustable wrenches are easier to use than socket or fixed end wrenches, both of which require the user to either replace the socket for different applications or change out the entire wrench. This is time consuming and tedious in working conditions. An adjustable wrench allows the user to adjust a single tool unit to the various shapes and sizes of bolts, both metric and standard.

The only drawback to adjustable wrenches is their gripping ability. Specifically, adjustable wrenches currently available are not able to fit a bolt as snugly as socket of fixed end wrenches. This often leads to stripping of the bolt head, which further complicates the loosening or tightening of a bolt. Generally, the advantage that socket and fixed end wrenches have in this regard is an increased contact area with the bolt head. Socket and fixed end wrenches are typically designed to contact each of the six corners of the bolt head as well as each side. The greater the contact area, the tighter the fit between the wrench and bolt. Thus, what is needed is a wrench that has the versatility of an adjustable wrench, but also the advantages of fixed and socket wrenches.

Most adjustable wrenches have two bolt claws that are adjustable relative to each other to contact the bolt head, typically on two opposing sides of the hexagonal bolt. Increasing the number of sides contacted, and the number of corners contacted would be ideal. This could be accomplished by increasing the number of bolt claws on the adjustable wrench, thus increasing the surface area of the bolt head contacted. There are pliers in the art that have such a feature. For instance, the Stallings (U.S. Pat. Nos. 1,250,690 and 1,498,488) inventions are pliers with two opposing claws, with a third pivotally mounted claw located central to the other two. The claw contact region is a complex structure, and the use of these pliers is directed towards general gripping of rounded surfaces such as pipes. These devices would not be suitable for a bolt wrench.

There are several other inventions directed towards an adjustable wrench. The Whelan (U.S. Pat. No. 1,401,931) invention is an adjustable pipe wrench that uses two opposing complex surfaced claws for gripping a pipe, with a third attachment coupled in such a manner to allow both parts to slide and pivot, increasing the contact surface area of the pipe being gripped. The Wei (U.S. Pat. No. 5,542,319) invention is an adjustable bolt wrench using two opposing bolt claws with a ratcheted handle. Although an improvement on the prior art, these two devices are either not directed towards a bolt wrench, or do not incorporate the advantages of fixed end wrenches by increasing the contact area of the bolt head and wrench. Thus, there is a need for a wrench that incorporates the ease of use of an adjustable wrench with the advantages of fixed end and socket wrenches.

SUMMARY OF THE INVENTION

An object of this invention is to provide a wrench that is easily adjustable in working conditions to various sized bolt heads.

Another object of the present invention is to provide an adjustable wrench with increased surface area contact between the bolt head and the contact portion of the adjustable wrench.

Another object of the present invention is to provide an adjustable wrench with a ratcheted operation to increase the ease and efficiency of use.

Another object of the present invention is to provide an adjustable wrench that has a specifically fitted bolt claw structure that will grip at least two of the bolt head sides and three equally spaced corners.

Additional objects, features and advantages will be apparent in the written description which follows. The invention is an adjustable wrench comprising a stationary arm with a terminal end and a grip end, the terminal end defining a lower bolt claw. A ratchet arm is coupled to the stationary arm, the ratchet arm being movable to control the movement of upper, lower and central bolt claws. The upper, central, and lower bolt claws define a fitted opening which forms a portion of the shape of a standard hexagonal bolt head, the fitted opening being adjustable to fit different sized bolt heads upon movement of the ratchet arm relative to the stationary arm.

The central bolt claw is fitted through a slot in the upper bolt claw which defines an inclined ramp surface such that movement of one claw is coupled to movement of the other claw. The central and upper claws move in unison in reaction to the stationary arm and lower bolt claw to form a tightly fitted surface for a bolt head. The stationary arm has a complex profile on its lower surface for contact with a ratchet pawl pivotally attached to the ratchet arm. The ratchet arm, having a grip end and a proximal end, is coupled to the central bolt claw at the proximal end. The ratchet arm is normally biased away from the stationary arm by a biasing spring, being manually pushed away from the stationary arm during adjustment of the wrench to a bolt.

Further, the central bolt claw is formed to fit an additional corner of a hexagonal bolt. The grip ends of the ratchet and stationary arms are held by the user in one hand to operate the single unit wrench. This configuration allows simplicity of use and improved gripping ability for standard hexagonal bolt heads.

DESCRIPTION OF THE DRAWINGS

FIG. 11A shows the wrench with the ratchet pawl disengaged, and FIG. 11B shows the wrench with the ratchet pawl engaged and the head of a bolt engaged by the bolt claws.

DESCRIPTION OF THE INVENTION

STRUCTURAL DESCRIPTION.

Figure 1:
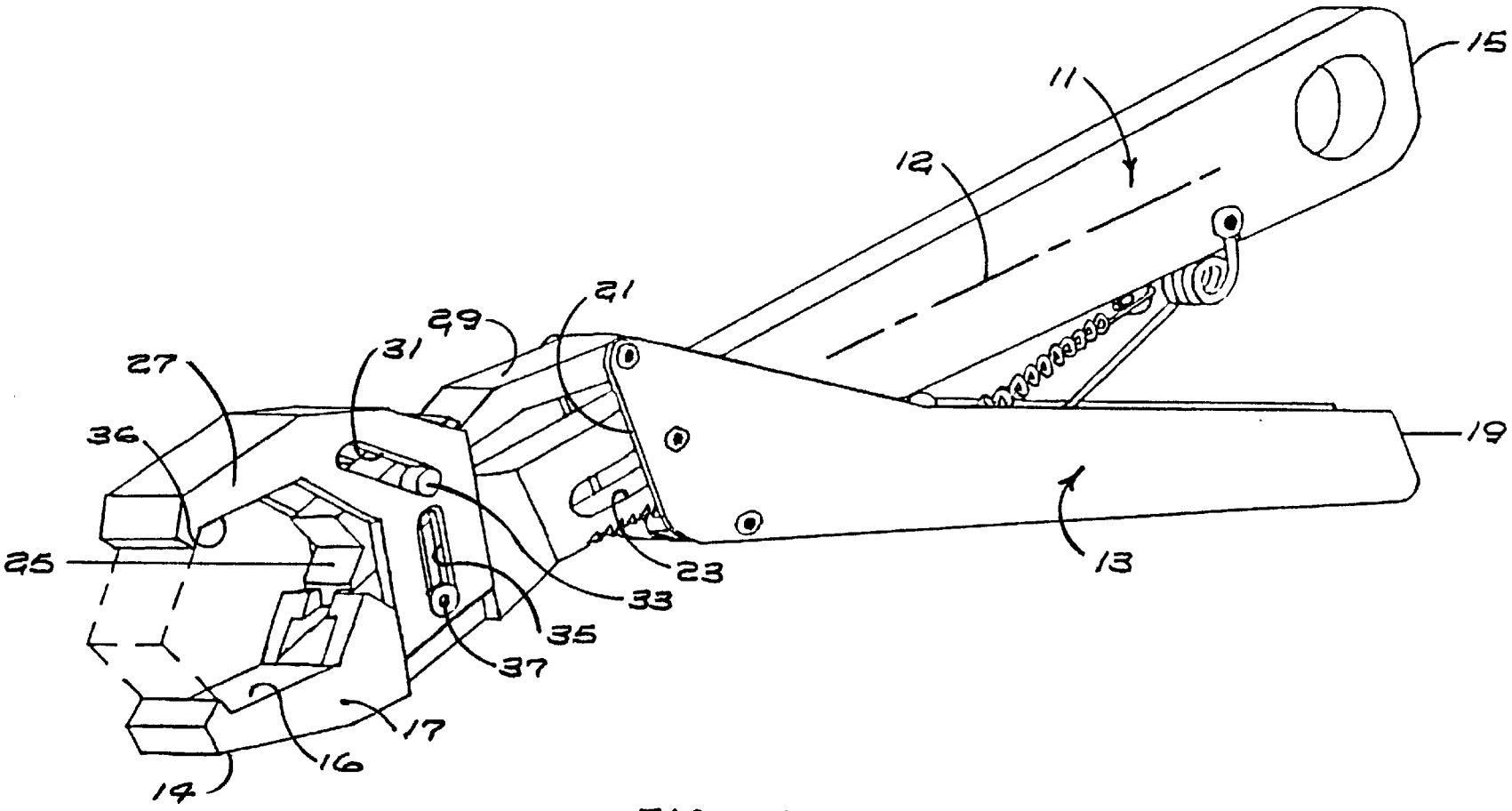
FIG. 1 is a perspective view of one embodiment of the adjustable wrench.

FIG. 1 shows one embodiment of the adjustable wrench of the invention. Stationary arm 11 and ratchet arm 13 are slidably coupled at slot 23 located on the stationary arm. The slot 23 forms an elongate opening along a horizontal axis 12 which is at an angle of 3° to 5° to the longitudinal axis of the stationary arm 11. The stationary arm has a grip end 15 and a terminal end defining a lower bolt claw 17. The lower bolt claw 17 has an exterior surface 14 and an interior surface 16. The interior surface 16 has a central planar extent and oppositely arranged angled surfaces which, together with the central planar extent, engage various sides of a standard hexagonal bolt head. A bolt is shown in dashed lines as it would be fitted within the claws of the invention.

The ratchet arm 13 has a grip end 19 and proximal end 21. A central bolt claw 25 is operatively coupled to the proximal end of the ratchet arm through lever 29, and the upper bolt claw 27 is operatively attached to the central bolt claw 25 through slot 31 on the upper bolt claw and toggle pin 33 on the central bolt claw. The upper bolt claw 27 is operatively attached to the stationary arm 11 through slot 35 on the upper bolt claw and toggle pin 37 on the stationary arm 11. The upper bolt claw 27 has an interior surface 36 which opposes the interior surface 16 of the lower bolt claw, defining a C-shaped opening for receiving a bolt head.

Figure 2:
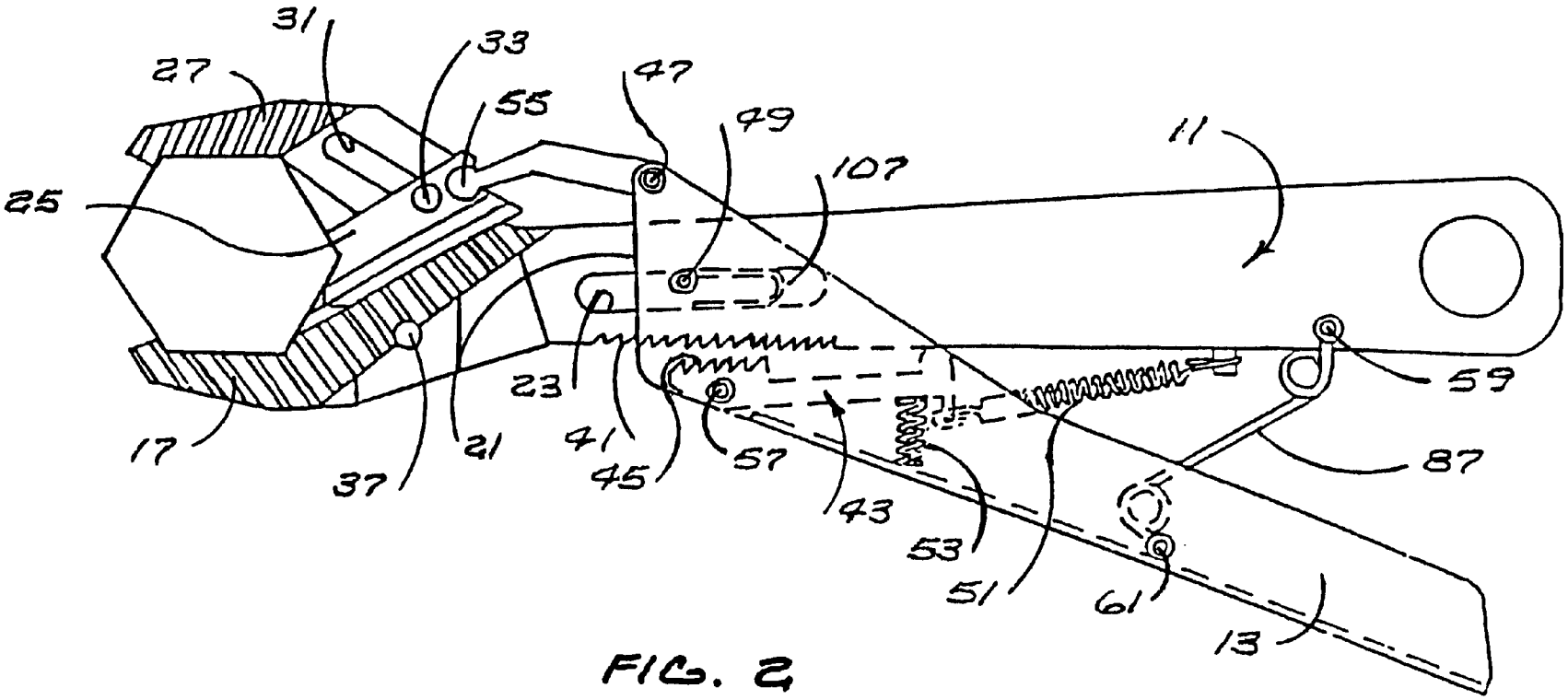
FIG. 2 is a side view of the adjustable wrench of FIG. 1, partly cutaway for ease of illustration.

FIG. 2 shows a cutaway view of the embodiment represented in FIG. 1. The lower bolt claw 17 and the upper bolt claw 27 are cut away to show how the central bolt claw 25 fits within. Inclined ramp surface 39 defines a surface upon which the central bolt claw 25 resides, being attached to the upper bolt claw 27 through toggle pin 33 on bolt claw 25, and slot 31 on the upper bolt claw 27. Toggle pin 37 on the lower bolt claw 17 is coupled to the upper bolt claw on each opposing side of the wrench. Lever 29 is coupled to central bolt claw 25 through pivot element 55, and to the proximal end 21 of the ratchet arm through toggle pin 47. Movement of the lever causes a cooperative action in the central and upper bolt claws relative to the lower bolt claw that becomes apparent upon further description of the this embodiment of the invention.

Figure 12A:
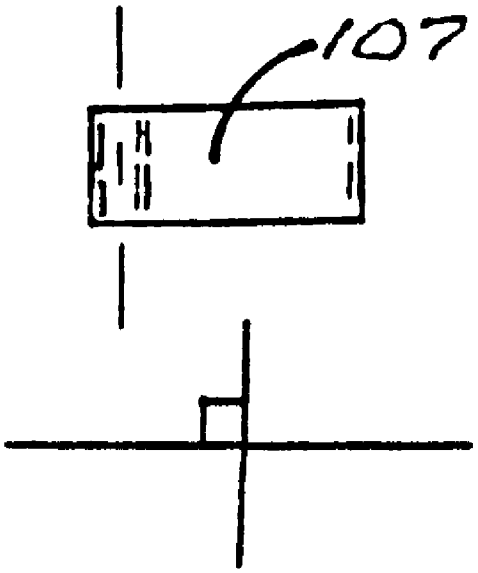
FIG. 12A is a top view of the slide pivot of the wrench.
Figure 12B:
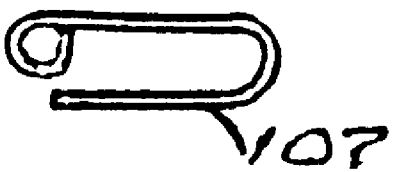
FIG. 12B is a side view of the slide pivot of the wrench.

FIG. 2 also shows hidden elements of the ratchet arm in phantom lines to further reveal the wrench's structure in this embodiment. Slide pivot 107 is coupled to the ratchet arm 13 through toggle pin 49. The slide pivot 107, in this case a 0.25 inch wide clip, typically made of 0.030 inch thick steel (see FIGS. 12A and 12B) resides within the slot 23. The lower surface of the stationary arm 11 has a complex surface 41 for frictionally contacting the mating surface of a ratchet pawl 43 at the surface 45 of the ratchet pawl. Once contacted, the frictional contact at 41 and 45 creates a stationary position.

Springs 51 and 53 operate the ratchet pawl, the pawl being attached to the ratchet arm through toggle pin 57. The springs 51 and 53 operate cooperatively to engage and disengage the ratchet pawl 43 and stationary arm 11. Compressible cantilevered spring 87 is attached to the stationary arm at rivet 59, and to the ratchet arm at hole opening 61.

Figure 3:
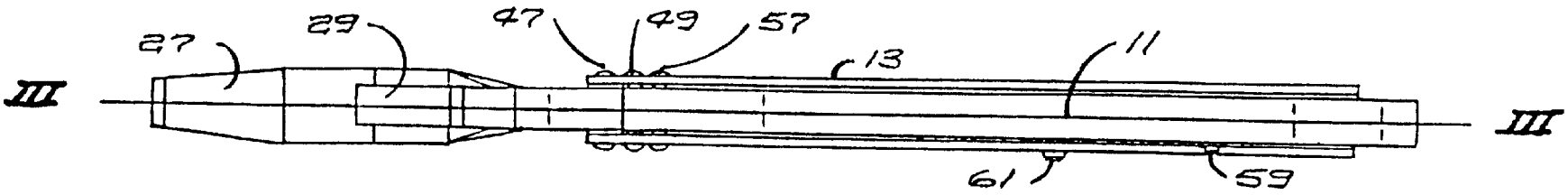
FIG. 3 is a top view of the adjustable wrench of FIG. 1.

FIG. 3 is a top view of the embodiment shown in FIG. 1. This view in FIG. 3 shows the symmetry of the toggle pins 47, 49, and 57 used for various attachments. These pins are located on opposing sides of the wrench and go through the wrench perpendicular to the longitudinal III—III axis. Pin 47 couples the lever 29 to the ratchet arm 13, pin 49 slidably couples the slide pivot 107 to the ratchet arm, and toggle pin 57 couples the ratchet pawl to the ratchet arm 13. Pin 61 is attached to one side of the ratchet arm 13 for coupling the cantileverd spring 87 to the ratchet arm, and pin 59 is attached to one side of the stationary arm 11 to couple the spring 87 to the stationary arm.

Figure 4:
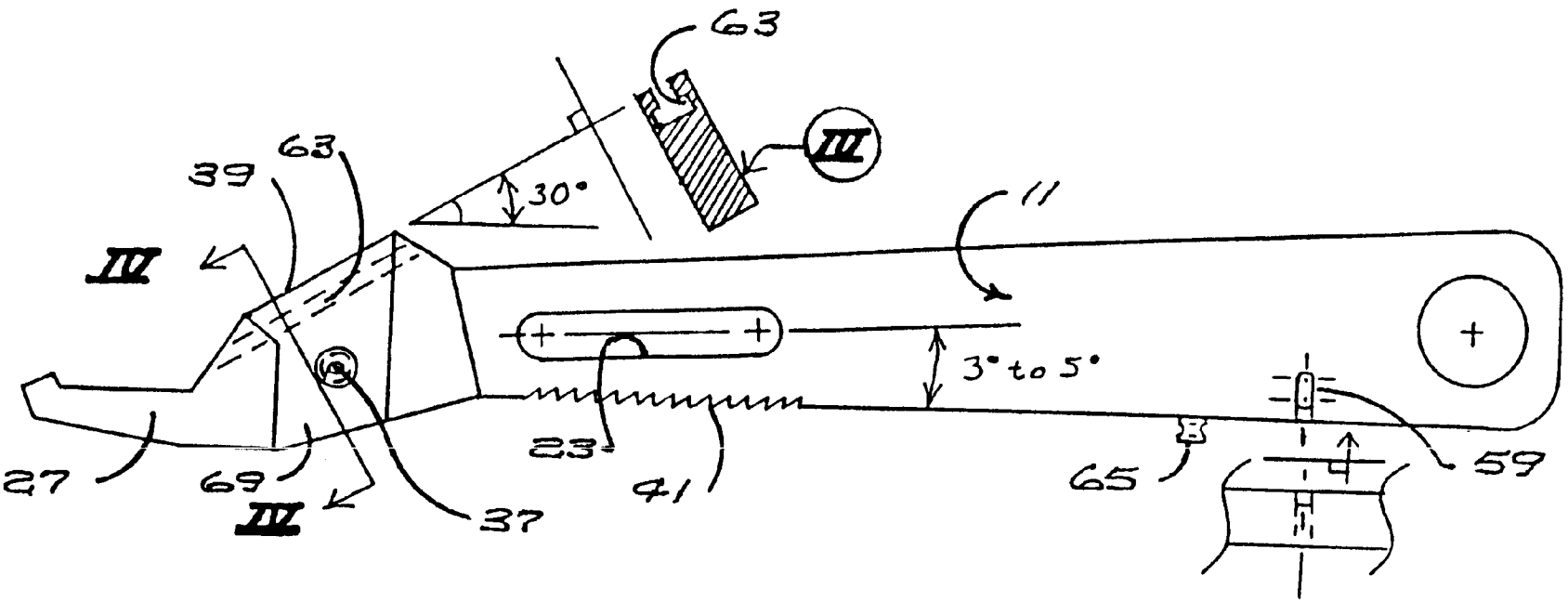
FIG. 4 is an isolated, side view of the stationary arm, showing the preferred angle of central bolt claw placement.

FIG. 4 is a side view of one embodiment of the stationary arm of the invention. Stationary arm 11 has a slot 23 for slidably attaching the ratchet arm. The complex lower sledge 41 of the stationary arm engages the ratchet pawl. Lower bolt claw 27 defines an inclined ramp surface 39 on which the central bolt claw can slide. The central bolt claw is slidably attached to the lower bolt claw through groove 63. The groove 63 is shown in an end view taken along the section lines IV—IV in FIG. 4, being complementarily fitted to the central blot claw. The upper bolt claw is coupled to the stationary arm 11 though toggle pin 37. The upper bolt claw is coupled such that it resides in channel 69 of the lower bolt claw 27 (the complementary channel on the opposing face not shown), channel 69 being recessed within the lower bolt claw 27 such that the complementary skirts 101 and 103 (see FIG. 7B) of the upper bolt claw are flush with the lower bolt claw and glide within the recessed channels.

Figures 5A, 5B:
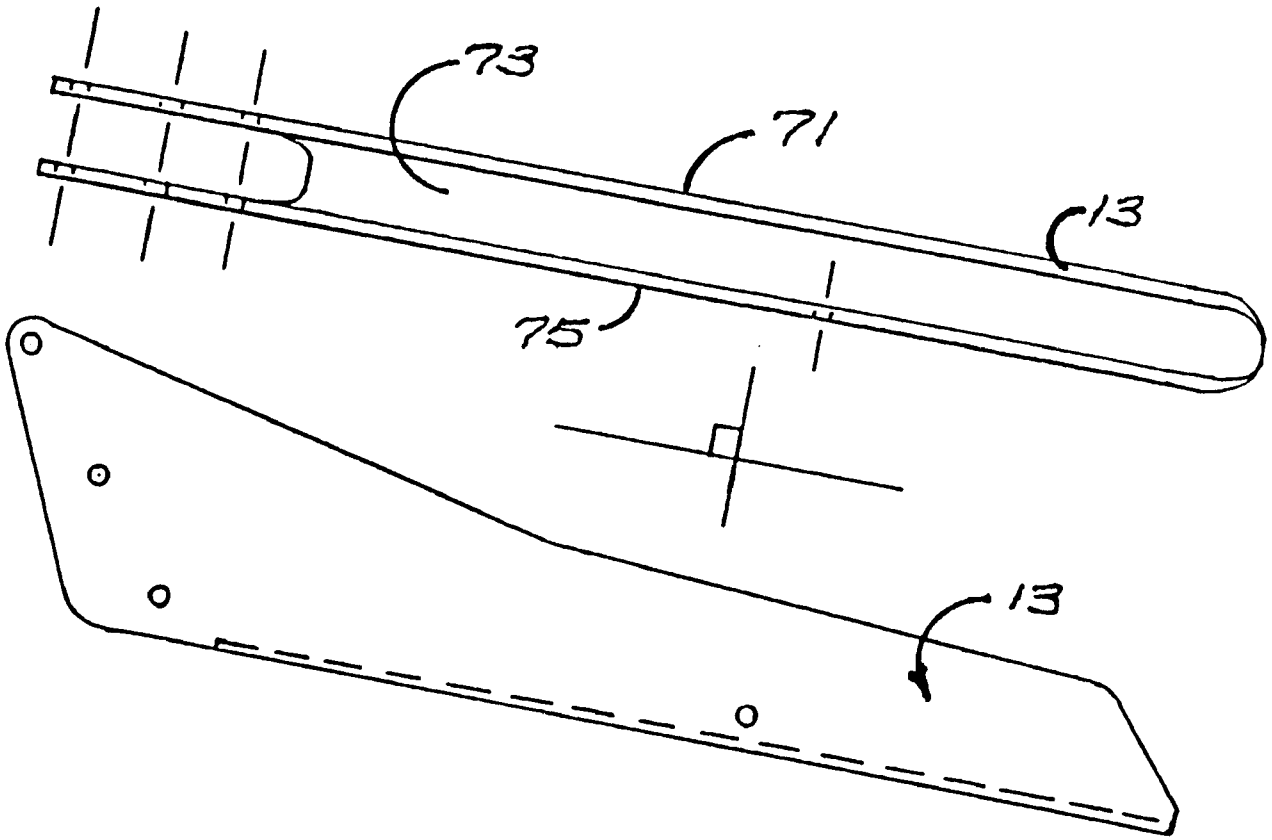
FIG. 5A is a side view of the rachet arm of the adjustable wrench of the invention.
FIG. 5B is a top view.

FIGS. 5A and 5B show the ratchet arm of the invention. FIG. 5A is a side view of the arm 13, and FIG. 5B is a complementary top view of the ratchet arm. This view shows the symmetry of the ratchet arm, the arm being formed with by rigid side walls 71 and 75 separated by bottom wall 73. The stationary arm 11 fits within the open cavity formed between the three sides 71, 73 and 75, forming a grip that can be easily handled with one hand, and operated by one hand.

Figure 6B:
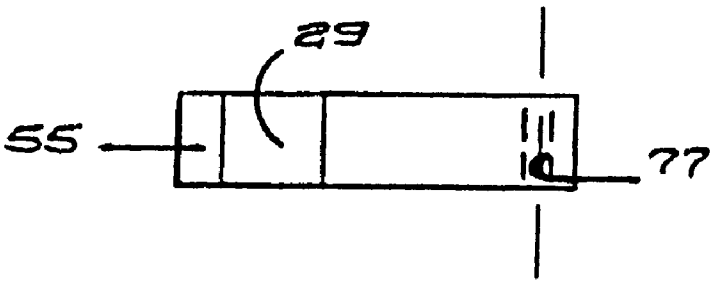
FIG. 6B is a top view.
Figure 6A:
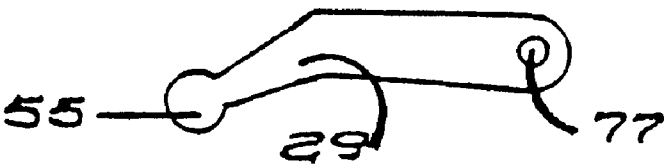
FIG. 6A is a side view of the lever component of the wrench.

FIGS. 6A and 6B are isolated views of the lever 29 that operatively couples the ratchet arm 13 with the central bolt claw 25. Pivot element 55 is coupled to the central bolt claw and allows for up and down movement of the lever relative to the bolt claw. Toggle pin hole 77, located perpendicular to the lever, holds toggle pin 47, coupling the lever to the proximal end 21 of ratchet arm 13.

Figure 7B:
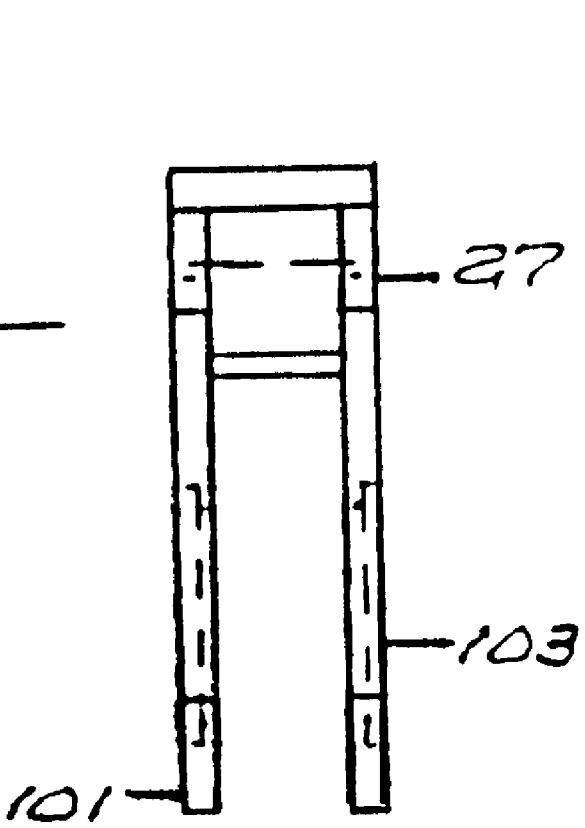
FIG. 7B is a back view.
Figure 7A:
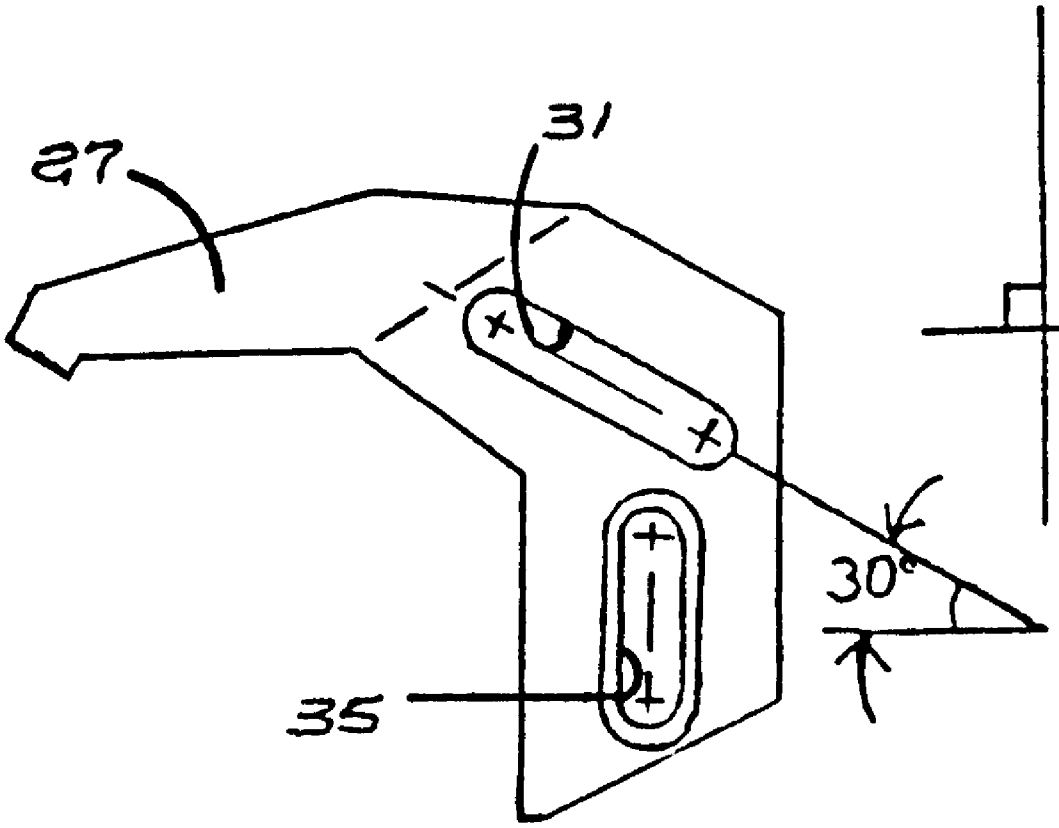
FIG. 7A is a side view of the upper bolt claw of the wrench.

FIGS. 7A and 7B are isolated views of the upper bolt claw 27 of the invention. FIG. 7A, a side view, shows the slots used for operatively attaching the claw 27 to the stationary arm and central bolt claw. Slot 31 forms the location for placement of the toggle pin 33 of the central bolt claw. This allows the central bolt claw to be movable back and forth through the slot. Slot 35 forms a similar placement location for the toggle pin 37 located on the stationary arm. This allows the upper bolt claw 27 to be movable in an up and down motion within the slots transverse to the stationary arm. The central bolt claw fits within the space 79 created by complementary skirts 101 and 103, and is movable in the plane of the stationary arm and upper bolt claw. The combination of toggle pin and slot couplings allows the cooperative movement of the upper and central bolt claws relative to the lower bolt claw to grasp a bolt head.

Figure 8B:
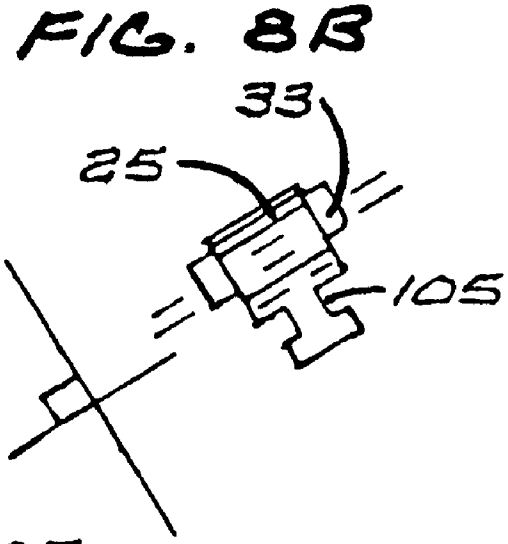
FIG. 8B is the back view.
Figure 8A:
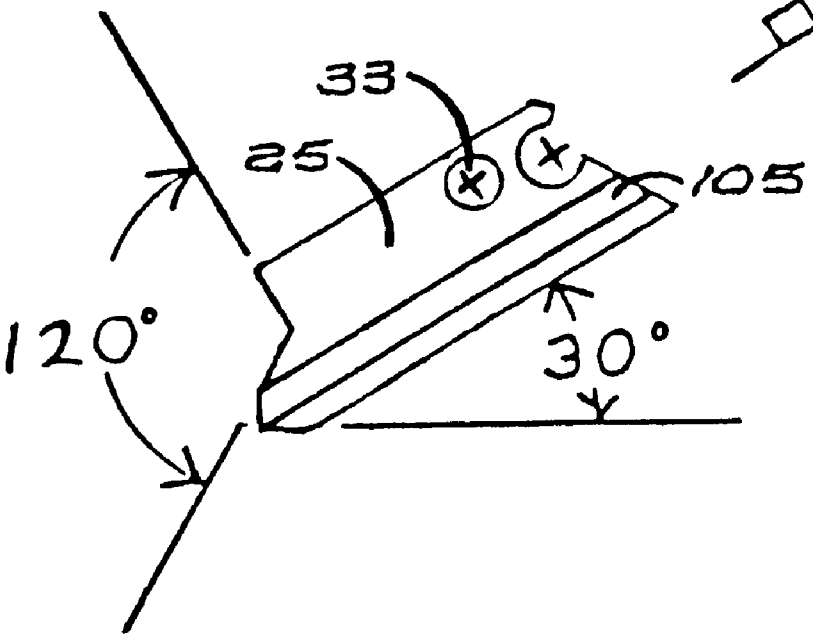
FIG. 8A is a side view of the central bolt claw of the wrench.

FIG. 8A and FIG. 8B are isolated views of the central bolt claw 25. The bolt claw is generally at a 30° angle to the stationary arm 11. The central bolt claw fits into the lower bolt claw through bevel 105 placement into groove 63. The bevel/groove coupling allows free movement of the central bolt claw when force is exerted from the lever 29.

Figure 9A:
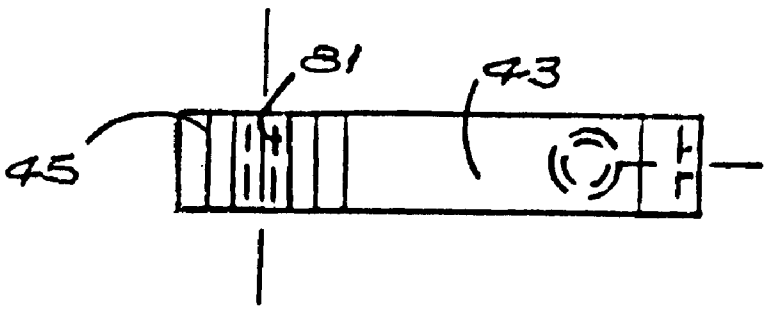
FIG. 9A is a bottom view of the ratchet pawl of the wrench.
Figure 9B:
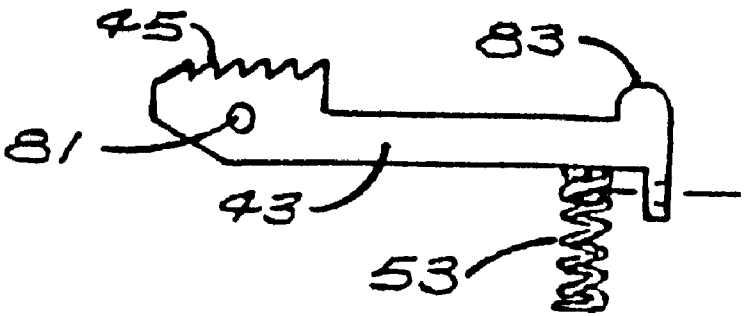
FIG. 9B is a side view.
Figures 10A, 10B:
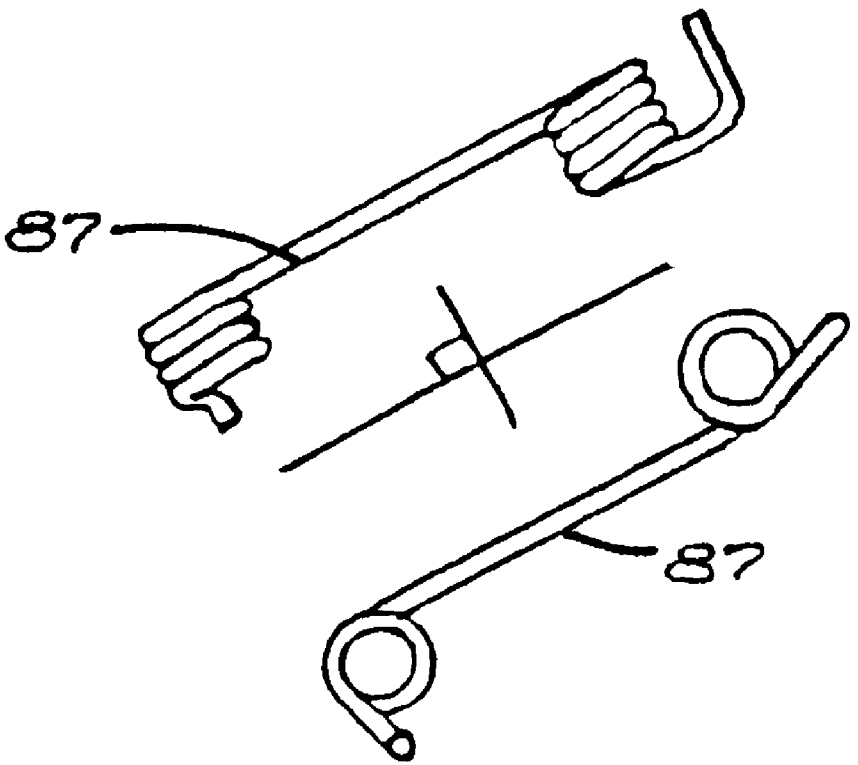
FIG. 10A is a side view of the compressible cantilevered spring of the wrench.
FIG. 10B is a top view of the compressible cantilevered spring of the wrench.

FIGS. 9A and 9B are isolated views of the ratchet pawl 43 of the invention. Ratchet pawl 43 has a toggle pin hole 81 where toggle pin 57 connects the pawl to the ratchet arm 13. A complex surface, in this case ratchet surface 45, makes frictional contact with a mating complex surface 41 located on stationary arm 11. Spring 53 engages the central wall 73 of the ratchet arm and the ratchet pawl. Pawl rider 83 stays in contact with stationary arm 11 because of the spring pressure of 53 and tension of spring 51. Surface 45 and 41 engage after bolt claws 27 and 25 engage a bolt head, and backfeed the 21 end of arm 13 downward to compress slide pivot 107, thereby mating the ratchet and pawl.

FUNCTIONAL DESCRIPTION.

Figure 11A:
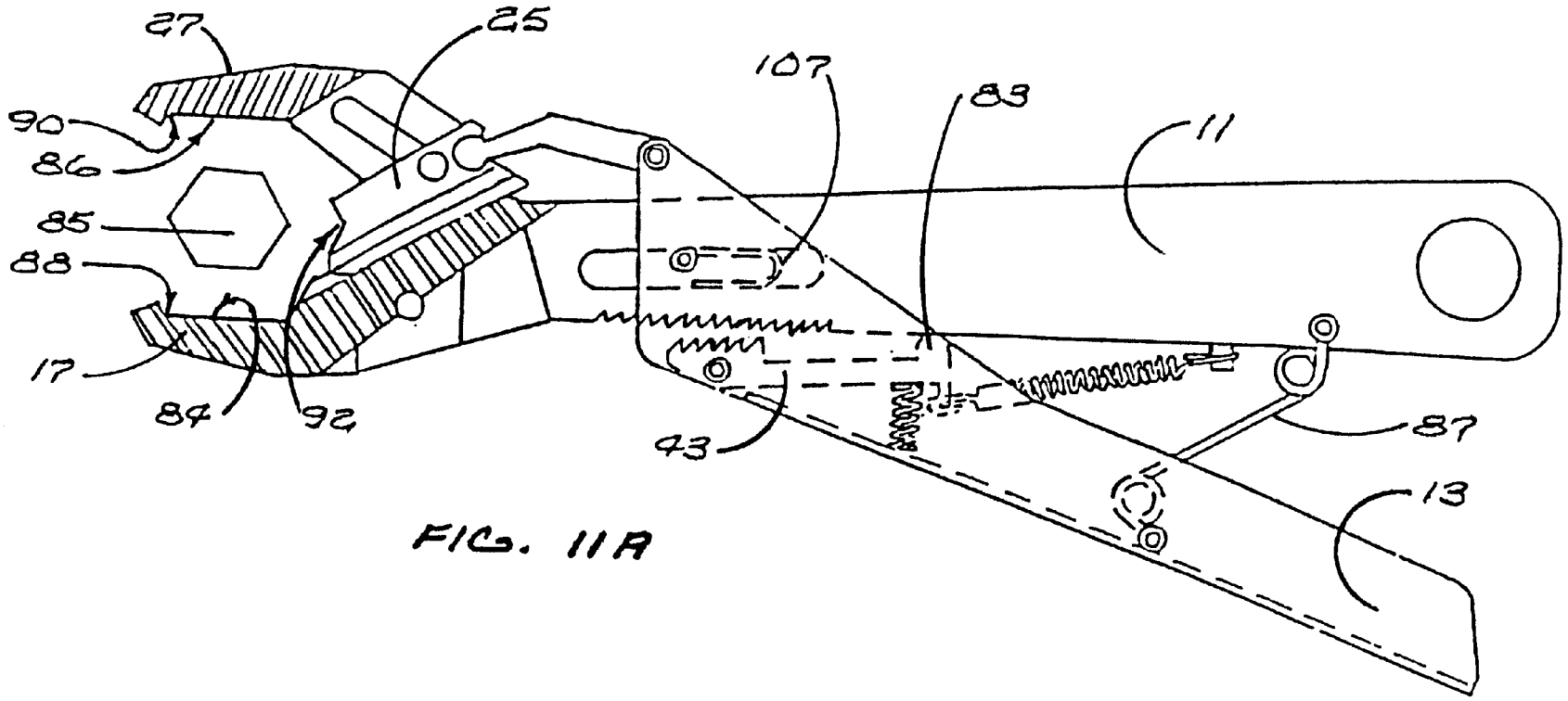
FIGS. 11A and 11B are side views of the wrench of the invention, partly broken away.
Figure 11B:
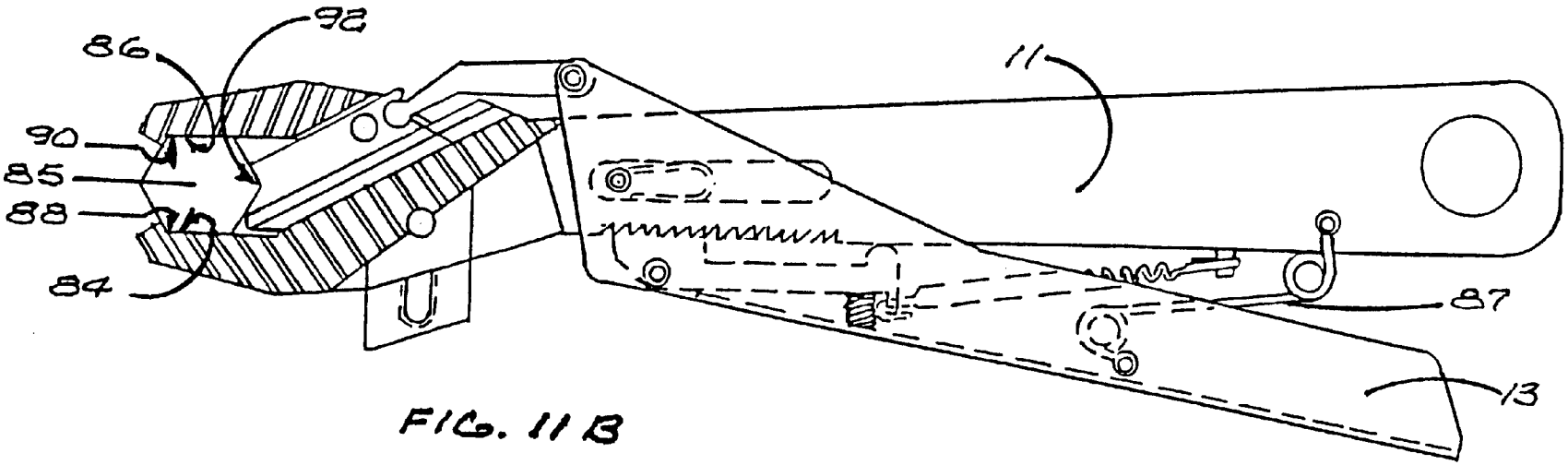

FIGS. 11A and 11B are operational views which illustrate the open and closed positions of the wrench, respectively. With the bolt claws of the wrench around a hexagonal bolt head 85 as in FIG. 9A, bringing the ratchet arm 13 towards the stationary arm 11 causes the central bolt claw 25 to move forward in the space 79 and groove 63 at the angle defined by inclined ramp surface 39. As the central bolt claw 25 moves forward, the upper bolt claw 27 moves down relative to the lower bolt claw 17, creating a closing action. The forward action of the central bolt claw, through the toggle pin 33 on central bolt claw 25, creates this closing action as the pin 33 in slot 31 forces the upper bolt claw 27 down against the hexagonal bolt.

When the upper and central bolt claws move to close onto a bolt head, further closing the handle moves the ratchet pawl 43 into frictional contact with the stationary arm complex surface 41, as shown in FIG. 9B. With the ratchet pawl and ratchet arm engaged as in FIG. 9B, the toggle pin 57 becomes a stationary pivot point for the ratchet arm 13. The toggle pin 49 couples the slide pivot 107 to the ratchet arm 13, the toggle pin/slide pivot combination slidably and pivotally coupling the ratchet and stationary arms. Thus, the toggle pin 57 defines a stationary point about which the stationary arm and ratchet arm pivot when a force applied to the 15 and 19 ends of the arms brings the arms together, or spring 87 forces the arms apart. Likewise, slide pivot 107 slides within slot 23 to create a slidable coupling of the ratchet and stationary arms, the link clip moving towards the bolt claw end of the stationary arm as the arms are brought together, and the link clip moving towards end 15 when the arms are forced apart.

Once the claws fit a bolt and the arms continue to close, the slide pivot 107 moves forward and is compressed within slot 23. The slide pivot 107 forces forward movement of the ratchet arm as it is being closed. The pawl rider 83 prevents rocking rearward of the ratchet pawl under strong force. At this point, pressure applied to closing the ratchet handle firmly holds the hexagonal bolt head at at least two edges and three corners as in FIG. 9B. Therefore, only a light to moderate pressure is required to hold a bolt without slipping or stripping of the bolt.

The present invention has several critical advantages over prior wrenches. By combining the ease of use of an adjustable wrench with the gripping ability of a fixed head or socket wrench, this invention solves many problems in the prior art. The adjustable wrench of the present invention makes use of a three-claw cooperative system to increase the contact surface area between bolt and wrench compared to the prior art adjustable wrenches. This decreases the chance for slipping of the bolt within the wrench claws, especially under high torsional force. Further, the snug fit of the claws of the present invention prevents the stripping of the bolt material. Stripping of the bolt head makes further and future use of the bolt impossible. Thus, the present invention is an improvement over the prior art.

The present adjustable wrench offers ease of use. It can be used with one hand, with leverage applied against the stationary arm to the ratchet arm in one hand to force the claws around a bolt, while a spring pushes the arms apart. The spring controlled ratchet pawl increases the ease of use of the wrench by holding the bolt claws in place. Also, the sliding pivot action in the connection between the arms allows for a wide range of bolt sizes to be fit within the bolt claws.

While the invention has been shown in only one of its forms, it is not thus limited but is susceptible to various changes and modifications without departing from the spirit thereof.

What is claimed is:

1. An adjustable wrench comprising:

a stationary arm with a terminal end and a grip end, the terminal end defining a lower bolt claw;

a ratchet arm coupled to the stationary arm;

a central bolt claw coupled to the ratchet arm;

an upper bolt claw coupled to the central bolt claw and to the stationary arm for simultaneous movement therewith;

the upper, central, and lower bolt claws defining a fitted opening which forms a portion of the shape of a standard hexagonal bolt head, the fitted opening being adjustable to fit different sized bolt heads upon movement of the ratchet arm relative to the stationary arm; and wherein the fitted opening defined by the upper, central and lower bolt claws encircles two sides and three corners of the hexagonal bolt head being received therein and partially encircles four remaining sides of the bolt head.

2. The adjustable wrench of claim 1, wherein the ratchet arm is both pivotally and slidably coupled to the stationary arm.

3. The adjustable wrench of claim 1, wherein the central bolt claw is pivotally connected to the ratchet arm and includes a slidable connection to the upper bolt claw.

4. The adjustable wrench of claim 1, wherein the central bolt claw moves on an axis which intersects an opening formed between the upper bolt claw and the lower bolt claw.

5. The adjustable wrench of claim 1, wherein the ratchet arm is movable between an open position and a closed position with respect to the stationary arm and wherein the ratchet arm is normally spring biased to the open position.

6. The adjustable wrench of claim 1, wherein the central bolt claw is fitted through a groove provided in the lower bolt claw defining an inclined ramp surface.

7. The adjustable wrench of claim 1, wherein the stationary arm has a bottom edge complex profile which forms a primary ratchet surface.

8. The adjustable wrench of claim 7, further comprising a secondary ratchet surface, formed on the ratchet arm for engaging the primary ratchet surface of the stationary arm as the ratchet arm is moved from the open to the closed position.

9. An adjustable wrench comprising:

a stationary arm with a terminal end and a grip end, the terminal end defining a lower bolt claw;

a ratchet arm coupled to the stationary arm for both pivotal and sliding movement relative to the stationary arm;

a central bolt claw coupled to the ratchet arm;

upper bolt claw coupled to the central bolt claw and to the stationary arm; and the upper, central, and lower bolt claws defining a fitted opening which forms a portion of the shape of a standard hexagonal bolt head, the fitted opening being adjustable to fit different sized bolt heads upon movement of the ratchet arm between an open and closed position relative to the stationary arm.

10. The adjustable wrench of claim 9, wherein the central bolt claw is fitted through a slot in the lower bolt claw defining an inclined ramp surface.

11. The adjustable wrench of claim 9, wherein the stationary arm has a bottom edge including a bottom edge complex profile.

12. The adjustable wrench of claim 11, wherein a ratchet pawl is pivotally coupled to the ratchet arm, the ratchet pawl having a pawl rider and having a complex profile fitting the bottom edge complex profile of the stationary arm.

13. The adjustable wrench of claim 12, wherein the ratchet pawl is fitted with a spring to force the pawl rider against the stationary arm bottom edge when the wrench is disengaged with a bolt.

14. The adjustable wrench of claim 13, wherein the ratchet arm has a proximal end and a grip end.

15. The adjustable wrench of claim 14, wherein the stationary arm and ratchet arm are associated with a spring that forces the ratchet arm away from the stationary arm at the grip ends of the arms.

16. The adjustable wrench of claim 15, wherein the proximal end of the ratchet arm is operatively associated with the central bolt claw.

17. The adjustable wrench of claim 16, wherein the upper, lower, and central bolt claws are fitted to a bolt head by movement of the ratchet arm grip end towards the stationary arm grip end.

18. The adjustable wrench of claim 17, wherein the proximal end of the ratchet arm is operatively associated with a lever arm, the lever arm having a first end and a second end.

19. The adjustable wrench of claim 18, wherein the ratchet arm is operatively associated with the first end of the lever arm, and the central bolt claw is operatively associated with the second end of the lever arm.

20. The adjustable wrench of claim 19, wherein the upper and lower bolt claws have terminal outer extents which are specifically fitted for gripping two sides and three corners of a bolt being gripped.

* * * * *